US006140967A

United States Patent [19]

Kolsrud

[11] Patent Number: 6,140,967

[45] Date of Patent: Oct. 31, 2000

[54] ELECTRONICALLY VARIABLE POWER CONTROL IN MICROSTRIP LINE FED ANTENNA SYSTEMS

[75] Inventor: Arild Kolsrud, Bridgewater, N.J.

[73] Assignee: Lucent Technologies Inc., Murray Hill, N.J.

[21] Appl. No.: 09/141,569

[22] Filed: Aug. 27, 1998

[51] Int. Cl.[7] ..... H01Q 13/10; H01Q 1/38

[52] U.S. Cl. ..... 343/700 MS; 343/767

[58] Field of Search ..... 343/700 MS, 767, 343/770; H01Q 1/38, 13/10

[56] References Cited

U.S. PATENT DOCUMENTS 5,142,255 8/1992 Chang et al. ..... 343/767

OTHER PUBLICATIONS

"Frequency Tunable CPW–Fed CPS Dipole Antenna Using Varactors," A. T. Kolsrud, M–Y. Li, and K. Chang, 0–7803–4478–2/98, 1998 Electronics Digest, IEEE Antennas and Propagation Society International Symposium, Jun. 21–26, 1998, Atlanta, Georgia, pp. 308–311.

"Electronically Switchable Slot Antenna Fed By Microstrip Line," A. T. Kolsrud, M–Y. Li, and K. Chang, 0–7803–4478–2/98, 1998 Electronics Digest, IEEE Antennas and Propagation Society International Symposium, Jun. 21–26, 1998, Atlanta, Georgia, pp. 1180–1183.

"Multiple Frequency Printed Slot And Dipole Antennas," a thesis by A. Kolsrud, submitted to the Office of Graduate Studies of Texas A&M University, Dec. 1997.

*Primary Examiner*—Hoanganh Le
*Attorney, Agent, or Firm*—Christopher N. Malvone

[57] ABSTRACT

A microstrip feeds a patch antenna through a slot in a two part RF ground plane. The dual RF ground planes permit DC control of a varactor positioned over a slot in the ground planes while maintaining a high degree of AC coupling between the two planes. The AC coupling between the two ground planes is increased by increasing the capacitive coupling between the planes using an interlocking finger pattern.

1 Claim, 2 Drawing Sheets

(PRIOR ART)

ELECTRONICALLY VARIABLE POWER CONTROL IN MICROSTRIP LINE FED ANTENNA SYSTEMS

BACKGROUND OF THE INVENTION

1. Field of the Invention

The present invention relates to antennas; more particularly, microstrip line fed antennas.

2. Description of the Related Art

FIG. 1 illustrates a microstrip fed patch antenna. Microstrip 10 is used to feed the RF energy to patch element 12. Positioned between microstrip 10 and patch element 12 are non-conductive material 14 and RF ground plane 16. It should be noted that material 14 may simply be an air gap. Dielectric material 14 should have as low a dielectric constant as possible to maximize RF coupling between the microstrip and the patch element. Ground plane 16 is in two parts 18 and 20. Parts 18 and 20 are separated by a DC blocking slot 22. Radiating slot 24 is an opening in ground plane 20 which permits RF energy to couple between microstrip 10 and patch element 12. Patch element 12 is elevated above ground plane 16 by plastic posts 26. Positioned over slot 24 is varactor 28. Varactor 28 is a two-terminal device where the capacitance of the device varies based on the voltage placed across terminals 30 and 32. By varying the voltage across terminals 30 and 32, the coupling of RF energy between microstrip 10 and patch element 12 can be maximized by using the variable capacitance to impedance match patch element 12 to microstrip 10.

FIG. 2 is a schematic diagram of the structure shown in FIG. 1. The RF energy is fed to microstrip 10 using RF source 50. One lead of RF source 50 is connected to microstrip 10 and one lead is connected to plane 18. The voltage across terminals 30 and 32 of varactor 28 are controlled using DC voltage source 52 where lead 54 is electrically connected to plane 18 and where lead 56 is electrically connected to plane 20. By varying the voltage produced by DC source 52, the capacitance introduced by varactor 28 can be varied to provide impedance matching between microstrip 10 and patch antenna element 12. Plane 16 which consists of portions 18 and 20 should look like a single RF ground plane in order to provide proper RF coupling between microstrip 10 and patch element 12. Unfortunately, it is also necessary to maintain a space between RF ground plane portions 18 and 20 in order to provide a voltage to terminals 30 and 32 of varactor 28. Unfortunately, there is insufficient AC coupling between RF ground plane 18 and 20 to make the two planes appear as a single ground plane to the RF circuit.

SUMMARY OF THE INVENTION

The present invention solves the aforementioned problem by providing dual RF ground planes that permit control of a varactor positioned over a slot in the ground planes while maintaining a high degree of AC coupling between the two planes. In one embodiment of the invention, the AC coupling between the two ground planes is increased by increasing the capacitive coupling between the planes using an interlocking finger pattern.

DETAILED DESCRIPTION OF THE INVENTION

Figure 1:
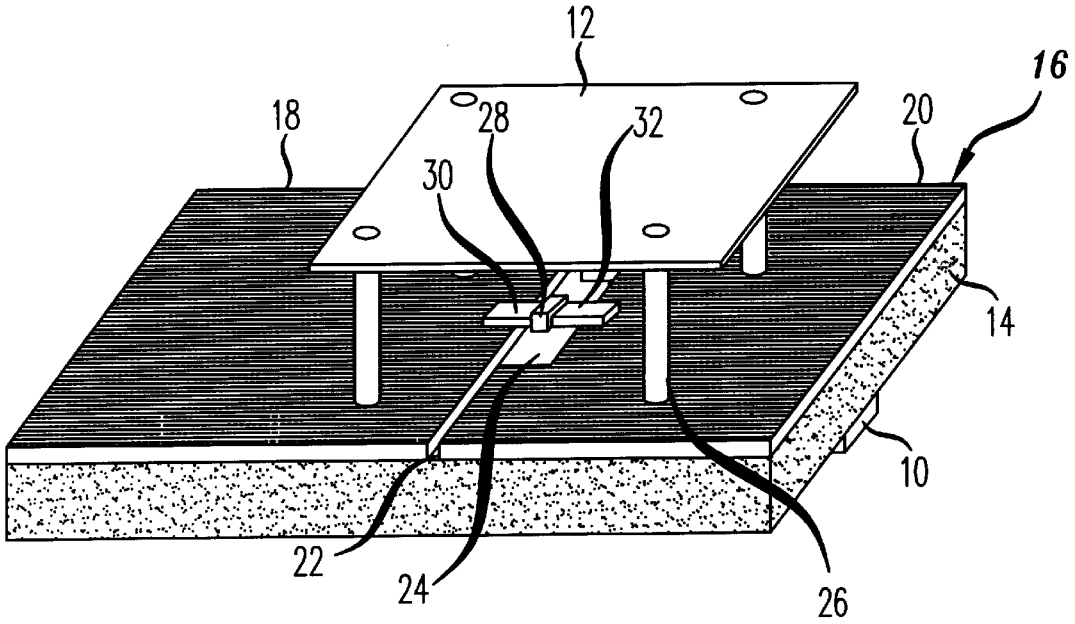
FIG. 1 is a diagram illustrating a prior art microstrip fed patch antenna element with a varactor used for impedance matching.
Figure 2:
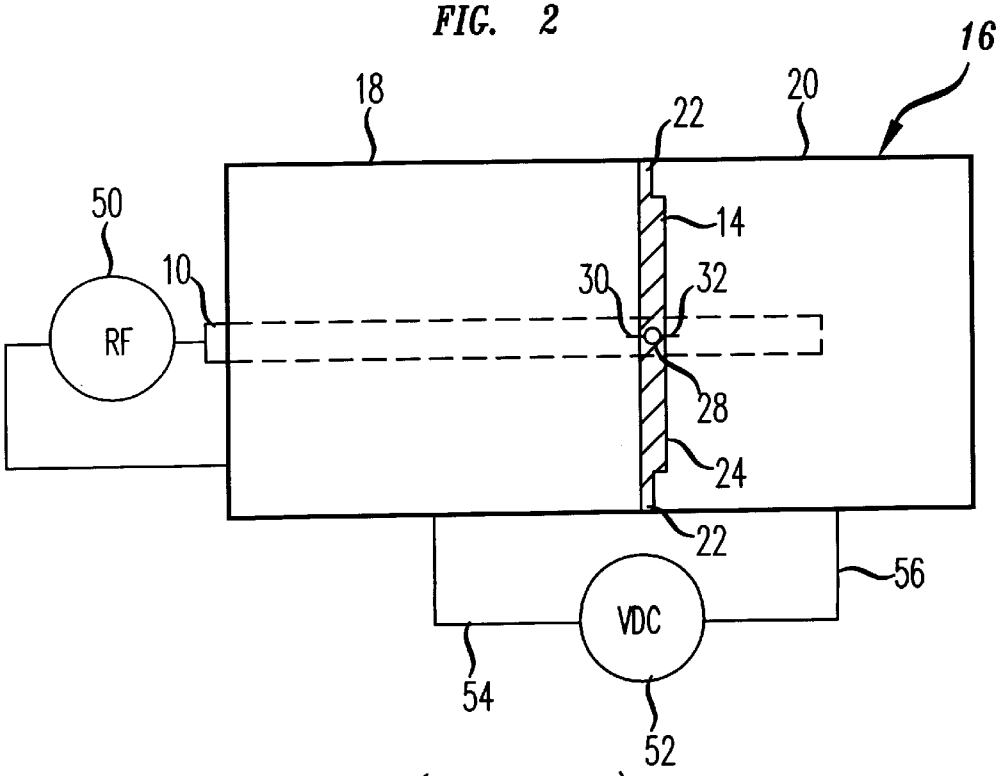
(PRIOR ART) FIG. 2
FIG. 2 illustrates a schematic diagram of the prior art structure shown in FIG. 1.
Figure 3:
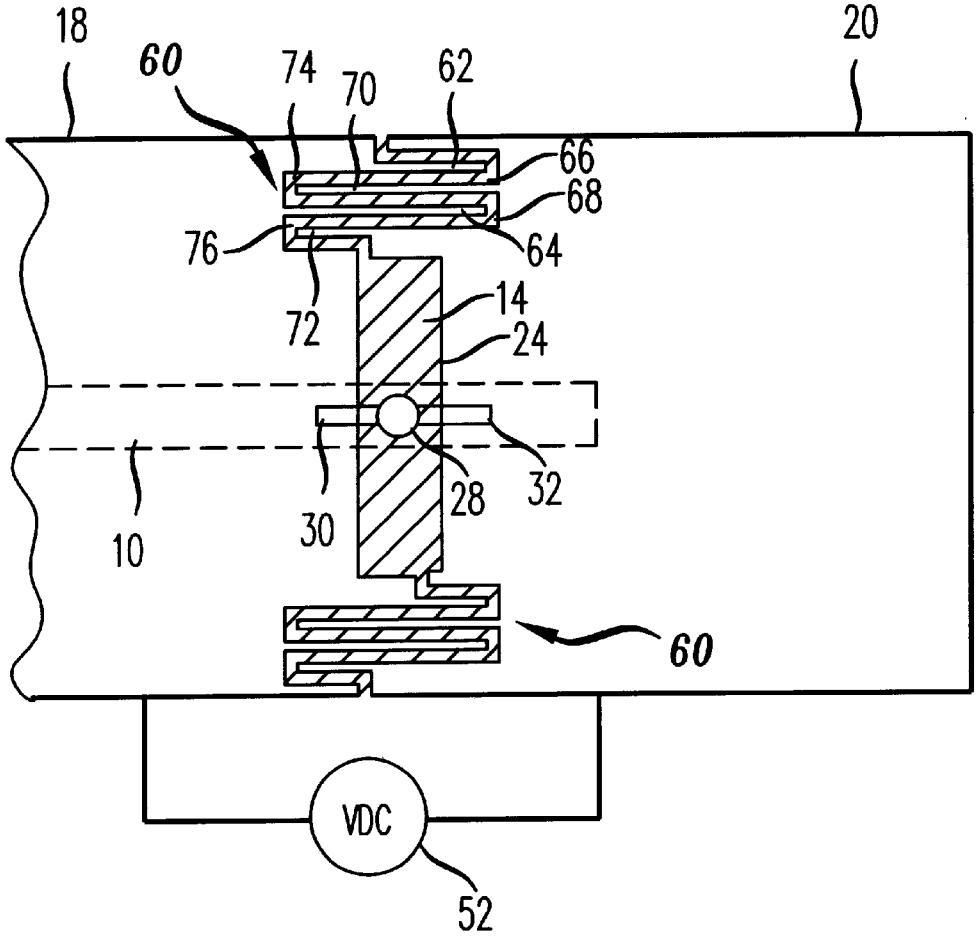
FIG. 3 illustrates a high capacitance DC blocking gap.

FIG. 3 illustrates a microstrip fed patch antenna system where the DC blocking gap between two RF ground planes includes an interlocking finger pattern. It should be noted that the antenna system may radiate directly from slot 24 without the patch element (not illustrated); however, patch the element improves the directivity of the radiation pattern. An active device such as varactor 28 with leads 30 and 32 is positioned across slot 24. Other devices such as a PIN diode, a Schottky diode, an FET transistor, or other devices having non-DC conductive reversed biased PN junction state may be positioned across slot 24. Varactor 28 is controlled by DC voltage source 52 which places a DC voltage across varactor leads 30 and 32 via RF ground plane 18 and 20. The DC blocking gap between planes 18 and 20, which prevents the short circuiting of DC voltage source 52, consists of interlocking finger pattern 60. The pattern consists of fingers or conductive surfaces 62 and 64 of plane 18 fitting into gaps 66 and 68, respectively of ground plane 20. Additionally, fingers or conductive surfaces 70 and 72 of ground plane 20 extend into gaps 74 and 76, respectively of ground plane 18.

This interlocking finger pattern greatly increases the capacitance between planes 18 and 20, and thereby decreases the AC impedance between the planes. As a result the two planes appear as a single ground plane to the RF circuit while appearing as two separate planes to the DC circuit that places a voltage across the varactor.

Figure 4:
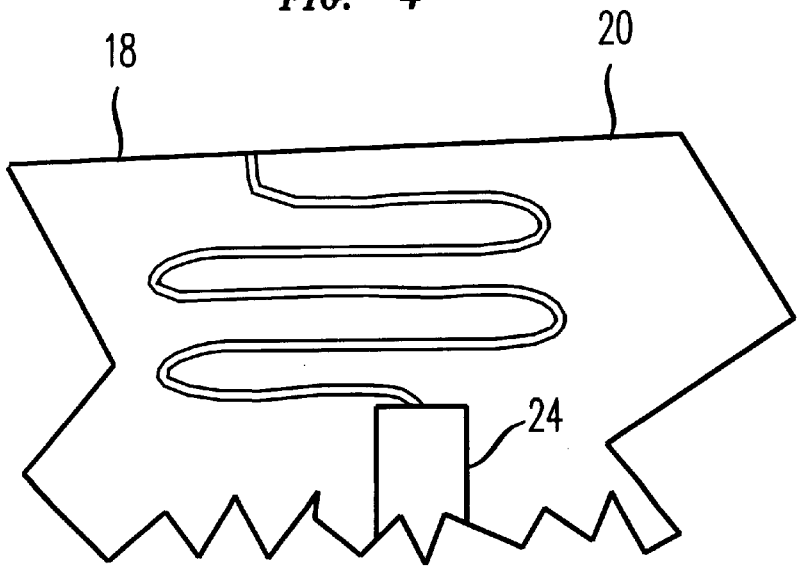
FIG. 4 illustrates an alternative high capacitance DC blocking gap.

FIG. 4 illustrates a similar high capacitance DC blocking gap between ground planes. This gap is serpentine in shape but also includes an interlocking pattern that provides high capacitive coupling.

The invention claimed is:

1. A slotted antenna, comprising:

a conductive ground plane having a first and a second part separated by a DC blocking slot, and a radiating slot to allow RF energy to pass through;

a conductor adjacent to a first side of the conductive plane where at least a portion of the conductor is positioned below the radiating slot;

the DC blocking slot between the first and second parts includes an interlocking finger pattern; and a non-conductive material positioned between the conductive plane and the conductor, where a finger of the first part of the conductive ground plane has a conductive surface that extends into a gap in the second part of the conductive ground plane and a finger of the second part of the conductive ground plane has a conductive surface that extends into a gap in the first part of the conductive ground plane.

* * * * *